United States Patent [19]

Scholle et al.

[11] 4,417,607

[45] Nov. 29, 1983

[54] APPARATUS AND METHOD FOR ASEPTICALLY FILLING FLEXIBLE CONTAINERS

[75] Inventors: William R. Scholle, Corona Del Mar; William J. Scholle, Irvine; Michael J. Gunning, Cerritos, all of Calif.

[73] Assignee: Scholle Corporation, Irvine, Calif.

[21] Appl. No.: 278,344

[22] PCT Filed: May 7, 1981

[86] PCT No.: PCT/US81/00614

§ 371 Date: Jun. 29, 1981

§ 102(e) Date: Jun. 29, 1981

[87] PCT Pub. No.: WO82/03832

PCT Pub. Date: Nov. 11, 1982

[51] Int. Cl.[3] ..... B65B 3/04; B67C 1/16; B67C 3/34

[52] U.S. Cl. ..... 141/1; 141/10; 141/92; 141/114; 141/154; 53/167; 53/389; 53/426; 134/134

[58] Field of Search ..... 53/167, 389, 426; 134/83, 134, 133; 141/10, 11, 48, 51, 63, 64, 69, 70, 82, 85, 89, 91, 92, 114, 313–317, 129–191, 1–9, 12, 350

[56] References Cited

U.S. PATENT DOCUMENTS

| | | | |
|---|---|---|---|
| 3,828,833 | 8/1974 | Smith | 141/85 |
| 3,913,634 | 10/1975 | Eisenberg | 141/51 |
| 4,120,134 | 10/1978 | Scholle | 141/114 X |
| 4,208,852 | 6/1980 | Pioch | 141/243 |

*Primary Examiner*—Houston S. Bell, Jr.

*Attorney, Agent, or Firm*—Knobbe, Martens, Olson & Bear

[57] ABSTRACT

An apparatus for aseptically filling premanufactured, presterilized, flexible containers, connected in a continuous web, includes a chamber with an inlet mouth for receiving empty containers seriatim, and an outlet mouth for dispensing filled containers seriatim. The inlet and outlet mouths have respective seals for sealing to the surface of the containers to prevent entry of contaminants into the chamber. This chamber is partitioned to form a spraying compartment, adjacent to the inlet mouth, and a filling compartment, adjacent to the outlet mouth, with a drying compartment therebetween. A sterilizing agent is continuously sprayed, as a mist, into the spraying compartment to coat the exterior of the containers with the sterilizing agent as they are serially advanced through the chamber. This mist also provides an aseptic barrier between the inlet mouth and the drying compartment. A source of sterile air is input to the filling compartment to maintain a positive pressure therein, and thus, prevent entry of contaminants. This heated sterile air flows from the filling compartment to the drying compartment to dry the containers after they have been sprayed. The containers are then advanced to the filling compartment where they are filled and dispensed through the outlet mouth.

The length of time the empty containers are exposed to the atmosphere, and thus, the amount of contamination on the exterior of the containers, may be reduced by utilizing the sealed overwrap bag, in which the containers are presterilized, to form a relatively sterile tunnel for feeding the containers to the inlet mouth.

39 Claims, 8 Drawing Figures

Fig. 3
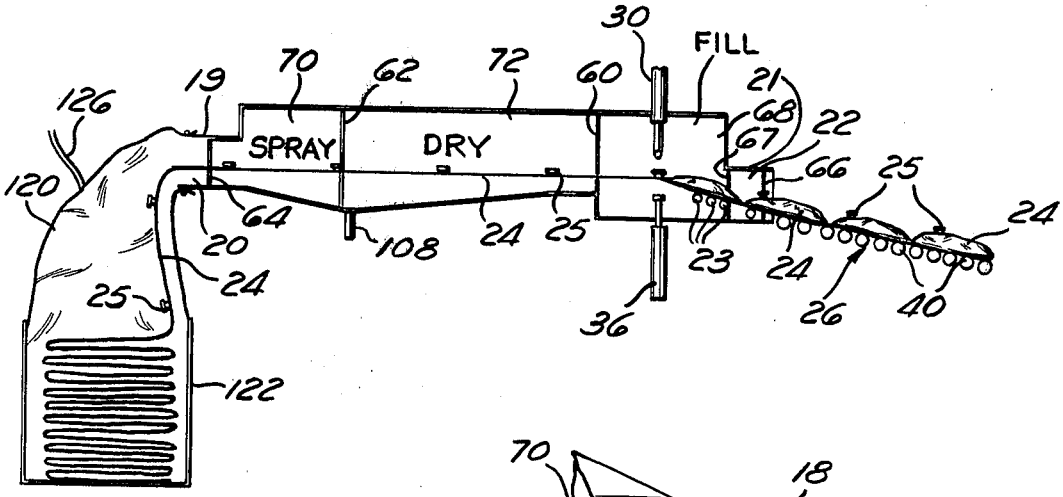
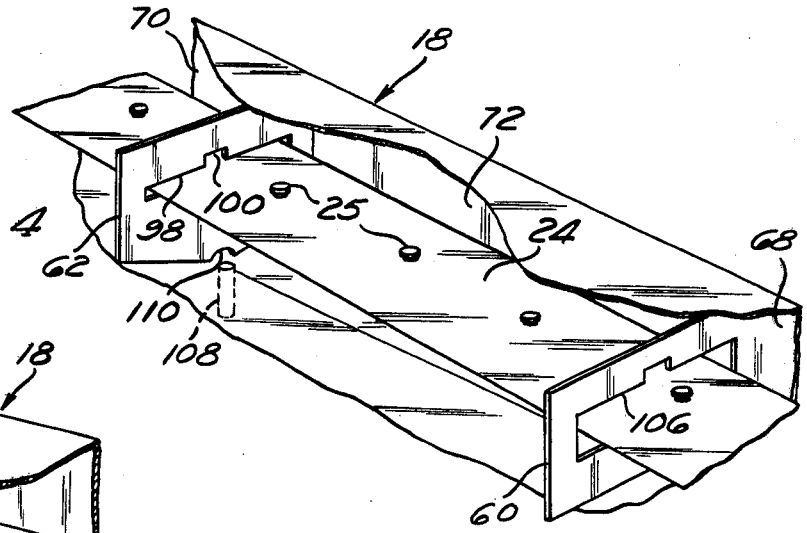
Fig. 4
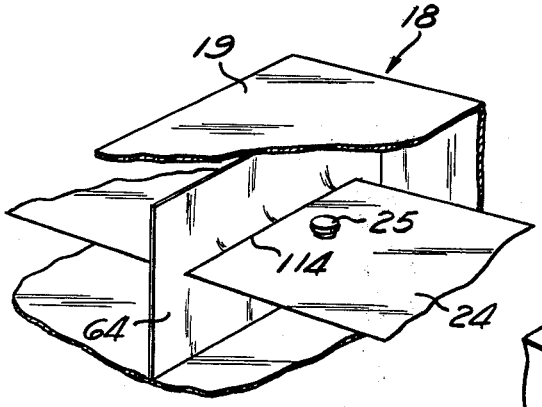
Fig. 5
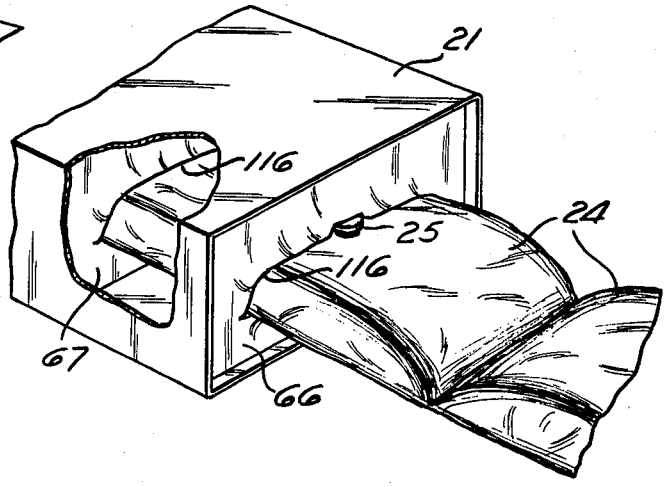
Fig. 6

APPARATUS AND METHOD FOR ASEPTICALLY FILLING FLEXIBLE CONTAINERS

BACKGROUND OF THE INVENTION

The present invention relates to an apparatus and method for filling flexible containers in an aseptic environment.

Flexible bags, comprised of a plastic material, such as polyethylene, are well suited as containers for fluid substances, such as milk, water, fruit juices, wine, and chemicals. Typically, a spout is provided, through which the container may be filled and the contents may be dispensed. The containers may be connected in continuous web form and filled by advancing the web of containers seriatim into a filling station, as described in U.S. Pat. No. 4,120,134, issued on Oct. 17, 1978 to William R. Scholle, and assigned to Scholle Corporation. The specification of that patent provides useful information helpful in understanding the context in which the present invention operates, and therefore, that patent is hereby incorporated herein by reference.

The apparatus described in U.S. Pat. No. 4,120,134 includes (a) feed means comprising conveyors for directing the continuous web, formed by the interconnected containers, from a supply carton onto a platform adjacent the filling station; (b) guide members for aligning the filling spout of each container as it moves along the platform; (c) a mechanism for uncapping, filling, and recapping each container at the filling station; and (d) means for releasing the filling spouts after each container is filled. As described in this patent, the containers may be advanced either by a mechanically driven conveyor or an inclined passive conveyor. The passive conveyor utilizes the gravitational force of the filled containers on an inclined unloading conveyor to pull the web of empty interconnected containers behind it.

Where the contents of the containers are consumable, measures must be taken to insure that such contents are free from contamination. If, for example, the containers are filled with high acid foods, it is necessary that the filling be performed under at least sanitary conditions. However, where low acid or neutral pH foods, such as milk, are involved, it is desirable that the filling be performed under aseptic conditions, since this permits such foods to have a longer shelf life than would otherwise be possible.

SUMMARY OF THE INVENTION

The present invention provides an apparatus and method for filling flexible containers in an aseptic environment. This apparatus comprises a tunnel-like, elongated chamber having an entry port, through which the empty containers are fed, and a dispensing port, through which the filled containers are dispensed. The chamber is partitioned into three compartments, including a sterilizing compartment, adjacent to the entry port, a filling compartment, adjacent to the dispensing port, and a drying compartment, interposed between the filling and sterilizing compartments. In addition, the entry and dispensing ports each have a seal, formed of elastomeric material with a slit therein, to reduce the risk of contaminant migration into the elongated chamber while permitting the containers to pass therethrough. A supply of sterilized air is continuously input to the filling compartment to pressurize the entire elongated chamber and provide a flow of sterile air therethrough to prevent entry of contaminants.

The present invention utilizes premanufactured containers, connected in a continuous web, which have been prepackaged in a sealed overwrap container and presterilized therein. The sealed overwrap container, which comprises, for example, a plastic bag, is positioned adjacent to the entry port. However, before opening the overwrap, it is preferably to apply a positive pressure within the overwrap container by introducing sterile air therein. This may be accomplished by providing a probe, connected to a source of sterilized air, which is used to puncture the wall of the overwrap and inflate the overwrap container. An opening is then formed in the overwrap container, as by slitting with a knife, to provide access to one end of the continuous web of containers packaged therein. An operator manually grasps the end of the continuous web, pulls it through the opening, and operably connects it to the feed means of the apparatus, for example, by clipping the leading edge of this continuous web to the trailing edge of the preceding continuous web of containers. While some contaminants may enter the overwrap container during this operation, it will be recognized that the continuous flow of sterile air from the probe through the overwrap container tends to reduce such contamination. After the continuous web of containers has been operably connected to feed through the elongated chamber, the peripheral edges formed by the opening in the overwrap are sealed to the mouth of the entry port, as by a resilient band. The air supply to the overwrap container may then be discontinued, and the probe, if desired, may be withdrawn, thereby leaving a small aperture in the wall of the overwrap container. It will be recognized, however, that, if the probe is withdrawn, the positive pressure in the elongated chamber should be sufficient to provide a sterile air flow to the overwrap container, thereby maintaining it at a positive pressure and preventing contaminants from entering through such aperture.

As the continuous web of containers is serially advanced into the elongated chamber, through the entry port, they initially pass through the sterilizing compartment, where they are coated with a fine, continuous mist of hydrogen peroxide. This resterilizes the outside of the containers, and thus, removes any contamination that may have occurred during the period when the overwrap container was open to the atmosphere. It will be understood that the inside of the containers need not be resterilized, since the containers are sealed with caps on their respective spouts, thereby preventing contamination.

As the containers are further advanced seriatim through the elongated chamber, they pass from the sterilizing compartment to the drying compartment, where the hydrogen peroxide coating is evaporated by a flow of heated, sterile air. Further serial advancement of the containers moves them from the drying compartment to the filling compartment where the spout caps are removed, the containers filled with a food substance, and the spout caps replaced. The filled containers are then advanced out of the filling compartment through the seal in the dispensing compartment, and onto the inclined conveyor. A severing bar disconnects adjacent filled containers at perforations in the container web between adjacent containers, so that the containers may be deposited into protective enclosures, such as cardboard boxes.

At all times during the foregoing process, the filling compartment is maintained at a positive pressure, by inputting, as discussed above, sterile air therein. This sterile air flows from the filling compartment to the drying compartment, and thus, also serves to maintain the drying compartment at a positive pressure. Further, the hydrogen peroxide mist in the sterilizing compartment provides an aseptic barrier between the drying compartment and the entry port. Thus, the filling compartment is constantly maintained in an aseptic condition as the containers are serially advanced therethrough.

The present invention, therefore, provides an aseptic environment for filling premanufactured, prepackaged, and presterilized, flexible containers, connected in continuous web form.

BRIEF DESCRIPTION OF THE DRAWINGS

These and other features of the present invention are best understood through reference to the drawings in which:

FIG. 3 is a schematic drawing of the elongated chamber of FIG. 1 showing the spraying compartment, drying compartment, and filling compartment;

FIG. 4 is a fragmentary, perspective view of the elongated chamber of FIG. 1, showing the configuration of the partition between the spraying compartment and drying compartment, and the configuration of the partition between the drying compartment and filling compartment; and further showing the tube which provides a drain for sterilant condensate and a vent for the sterile air flow through the elongated chamber;

FIG. 5 is a fragmentary perspective view of the containers being received into the chamber through the inlet mouth, showing the elastomeric seal sealing to the exterior of the containers;

FIG. 6 is a fragmentary, perspective view of the filled containers being dispensed through the outlet mouth, showing the elastomeric seals sealing to the exterior of the filled containers;

DETAILED DESCRIPTION OF THE PREFERRED EMBODIMENT

Figure 1:
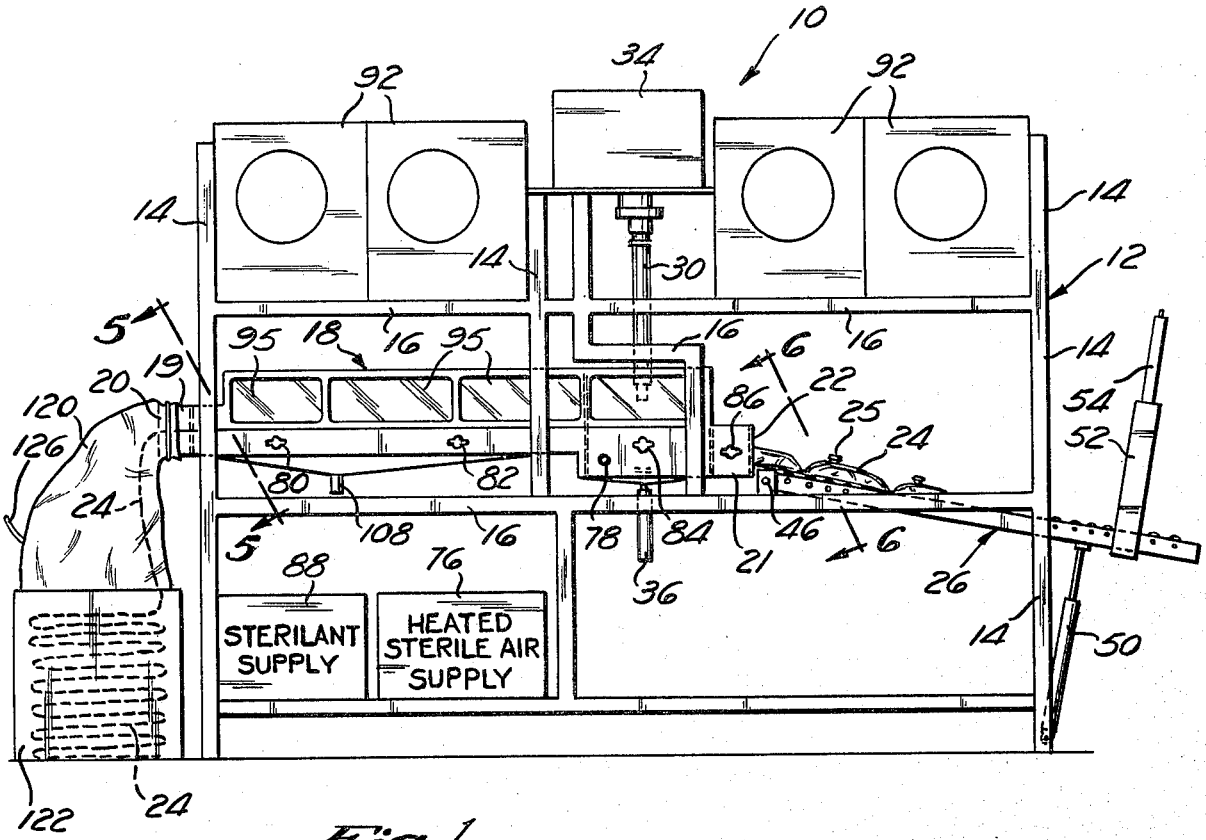
FIG. 1 is an elevation view of the aseptic filling apparatus of the present invention showing the elongated chamber receiving a continuous web of flexible bags through an inlet mouth, and dispensing the containers through an outlet mouth and onto the inclined conveyor, after the containers have been filled by the filling nozzle.

Referring to FIG. 1, the aseptic filling apparatus 10 of the present invention includes a skeletal support frame 12 formed by plural upstanding posts 14 interconnected by plural cross members 16.

Figure 2:
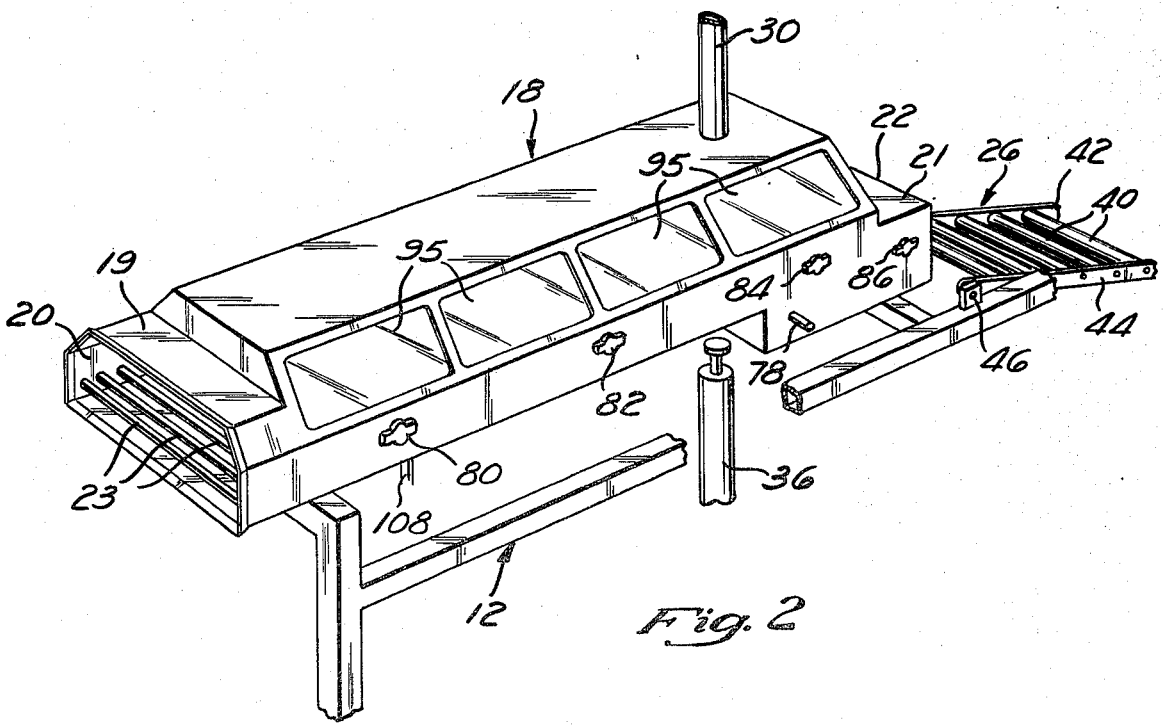
FIG. 2 is a partial perspective view of the sterile chamber of FIG. 1.

The support frame 12 mounts an elongated chamber 18, having an inlet mouth 19, which forms an entry port 20 at one end of the chamber 18, and an outlet mouth 21, which forms a dispensing port 22 at the opposite end of the chamber 18, as shown in FIGS. 1 and 2. A continuous web of containers 24, having respective spouts 25, are fed seriatim into the entry port 20. Container support rollers 23 (FIG. 2), horizontally mounted between the sides of the chamber 18, provide support for the containers 24 as they are advanced through the elongated chamber 18 by a passive, inclined conveyor 26, as describrd in U.S. Pat. No. 4,120,134, issued on Oct. 17, 1978, to William R. Scholle, and assigned to Scholle Corporation, which patent is hereby incorporated by reference. Alternatively, the containers 24 may be advanced through the elongated chamber 18 by the mechanically driven mechanisms described in U.S. Pat. No. 4,120,134, or in copending patent application Ser. No. 245,394 entitled "Container Conveyor For a flexible Container Filling Machine", filed Mar. 19, 1981, by Roger H. Ellert, inventor, which is also hereby incorporated herein by reference.

As shown in FIGS. 1 and 2, a filling nozzle 30, for filling the comtainers 24, extends through, and is sealed to, the top of the elongated chamber 18, near its dispensing end. When a container spout 25 reaches a position beneath this nozzle 30, it is uncapped, filled by the nozzle 30, and recapped.

The nozzle 30 is connected to a flow controller 34, mounted on the frame 12, which dispenses measured amounts of product, such as a food substance, through the spout 25 and into the container 24. After the container spout 25 has been uncapped, and the container 24 has been filled by nozzle 30, a vertical post 36 is advanced upward to cause the lower wall of the container 24 to seal off the container spout 25 prior to capping to prevent entry of air into the filled container 24. Further details of this filling mechanism, as well as a capping mechanism for uncapping and recapping the spouts 25, are provided in the above-referenced U.S. Pat. No. 4,120,134.

After filling, the containers 24 are advanced through the dispensing port 22 and onto the inclined conveyor 26. This inclined conveyor 26 comprises plural idle rollers 40 connected between opposing side frames 42,44. The side frames 42,44 are rotatably connected at one end to respective brackets 46 connected to a cross member 16 of the support frame 12. The brackets 46 are positioned to permit the conveyor 26 to receive filled containers 24 from the dispensing port 22. The end of the inclined conveyor opposite the dispensing port 22 is supported by a post 50, which may be telescopingly adjusted to vary the angle of inclination of the inclined conveyor 26. A container separator 52 having a severing bar 54 is connected to the side frames of the conveyor 26. This separator 52 serves to disconnect adjacent filled containers 24 at perforations, preformed in the container web between adjacent containers 24, so that the containers 24 may be deposited into protective enclosures, such as cardboard boxes.

THE CHAMBER 18

As best seen in FIG. 3, the elongated chamber 18 is divided into a filling compartment 68, a spraying compartment 70, and a drying compartment 72. These compartments 68,70,72 are formed by partitions 60,62, oriented perpendicularly to the longitudinal axis of the chamber 18. The filling compartment 68 is bounded by the outlet mouth 21 on one end and the partition 60 on the other end. The filling nozzle 30 projects into this compartment 68. Further, the spraying compartment is bounded by the inlet mouth 19 and the partition 62, while the drying compartment is bounded by the partitions 60,62.

An elastomeric seal 64 is provided across the inlet mouth 19 to seal the entry port 20. The outlet mouth 21 is provided with two elastomeric seals 66,67, in spaced, parallel relationship, to form a double seal across the dispensing port 22. The partitions 60,62, and seals 64,66,67, all have opening, described in detail below, to permit passage of the continuous web of containers 24 through the chamber 18.

Referring again to FIGS. 1 and 2, a source of sterile, heated air 76 is connected by tubing (not shown) to an inlet tube 78 in the filling compartment 68 (FIG. 3) of the elongated chamber 18. The chamber 18 also has plural spray heads 80,82,84,86 connected thereto, which are positioned to spray the compartments 70,72,68, and mouth 21, respectively. Each of these spray heads 80,82,84,86 is connected by tubing (not shown) to the sterile air supply 76 and to a sterilant supply 88 containing, for example, a 30-percent solution of hydrogen peroxide in water. The spray heads 80,82,84,86 atomize the hydrogen peroxide solution into a fine mist or fog, and spray such mist into the spraying compartment 70, drying compartment 72, filling compartment 68, and dispensing mouth 21, respectively.

STERILIZING THE CHAMBER 18

Prior to utilizing the aseptic filling apparatus 10 of the present invention, the elongated chamber 18, as well as the product contact surfaces, should be sterilized to ensure that filling is performed in an aseptic environment. This is accomplished by spraying the above-described hydrogen peroxide solution through each of the spray heads 80,82,84,86 simultaneously, to sterilize the entire chamber 18. Sterile air is then supplied from the air source 76 to the inlet tube 78 to maintain the filling compartment 68 at a positive pressure, and thus, in an aseptic condition. As will be described in more detail below, this sterile air flow also maintains the drying chamber 72 and dispensing mouth 21 at a positive pressure, and, therefore, also in an aseptic condition. Once the sterile air flow to the filling compartment 68 has been started, the spray heads 82,84,86 may be shut off. However, the spray head 80 continuously operates to supply a mist of hydrogen peroxide to the spraying chamber 70, during the operation of the apparatus 10, to provide an aseptic barrier between the inlet mouth 19 and the drying compartment 72. Thus, the hydrogen peroxide mist in the spraying chamber 70, together with the sterile air flow into the filling compartment 68, serves to prevent comtaminants from entering the elongated chamber 18.

It will be understood that the product contact surfaces, such as the interior surface of the filling nozzle 30, are also sterilized prior to use of the apparatus 10. This is accomplished in a manner well known to those skilled in the art, for example, by steam sterilization techniques.

Controllers 92 monitor, record, and control the above-described processes and continually regulate flow rate, pressure, and temperature variables, such as the source temperature of the sterilized air, the air pressure in the filling compartment 68, the temperature of the air flow through the drying compartment 72, and the temperature of the steam for sterilizing the product contact surfaces. Windows 95 are provided in the side of the chamber 18 for viewing the operation of the apparatus 10.

The Partitions 60,62 and Seals 64,66,67 of the Chamber 18

Before turning to the operation of the container filling apapratus 10, the partitions 60,62 and the seals 64,66,67, shown in FIG. 3, will be described in more detail. Referring to FIG. 4, the partition 62 includes an opening 98, sized to permit the continuous web of containers 24 to pass therethrough. The contour of the opening 98 is generally rectangular with a notch 100 formed along its upper edge to accommodate the filling spouts 25 of the containers 24. The tolerance between the edge of the opening 98 and the containers 24 should be relatively close to reduce the amount of hydrogen peroxide mist passing through the opening 98. However, such tolerance should not be so close that the edges of the opening 98 wipe the web of containers 24 as they pass therethrough. Because of the relatively close tolerances between the edges of the opening 98 and the web of containers 24, it is preferable that the partition 62 be formed of a flexible, resilient material so that a slight misalignment between the notch 100 and the spout 25 will not prevent advancement of the containers 24 through the opening 98.

The partition 60 has an opening 106 of generally the same conntour as the opening 98 to permit passage of the web of containers 24 therethrough, as shown in FIG. 4. However, the opening 106 is substantially larger than the opening 98 to permit the previously described flow of sterile air through the inlet tube 78 (FIG. 2) to pass from the filling compartment 68, through the opening 106, and into the drying compartment 72. A vent tube 108 is included in the bottom of the drying compartment 72, adjacent to the partition 62, to provide an outlet for the sterile air after it has travelled the length of the compartment 72. It will be understood that this flow of sterile air also maintains a positive pressure in the drying compartment 72 and thus reduces any tendency of the hydrogen peroxide mist in the spray compartment 70 to migrate through the opening 98. Such positive pressure also prevents contaminants from entering the compartment 72 through the vent tube 108.

A small opening 110, centered at the bottom of the partition 62, adjacent to the vent 108, permits hydrogen peroxide condensate formed in the spray compartment 70 to drain through this opening 110 and into the vent 108. This vent 108 also serves to drain any hydrogen peroxide condensate in the drying compartment 72. Accordingly, the bottom walls of the spray compartment and drying compartment are sloped towards this drain 108 to provide troughs for carrying condensate thereto. The vent 108 is connected by tubing (not shown) to a location suitable for disposal of the hydrogen peroxide.

Referring to FIG. 5, the entry port seal 64 is formed from an elastomeric membranous material, such as dental dam, and includes a horizontal slit 114, slightly greater in length than the width of the continuous web of containers 24 to permit such containers 24 to pass therethrough. Thus, the edges of the slit 114 seal to the outer surface of the empty containers 24 to reduce contaminant entry into the chamber 18. The dispensing port seals 66,67, shown in FIG. 6, are identical to the entry port seal 64, except that they have respective slits 116 sized to permit filled containers 24 to pass therethrough. Like the slit 114, the slits 116 are elastomeric so that they (a) expand to permit passage of the containers 24, and (b) seal to the outer surface of the containers 24. Thus, the seals 66,67, together with the positive pressure in the filling compartment 68, provide a barrier against contaminant entry through the mouth 21 and into the compartment 68.

The Flexible Containers 24

Figure 7:
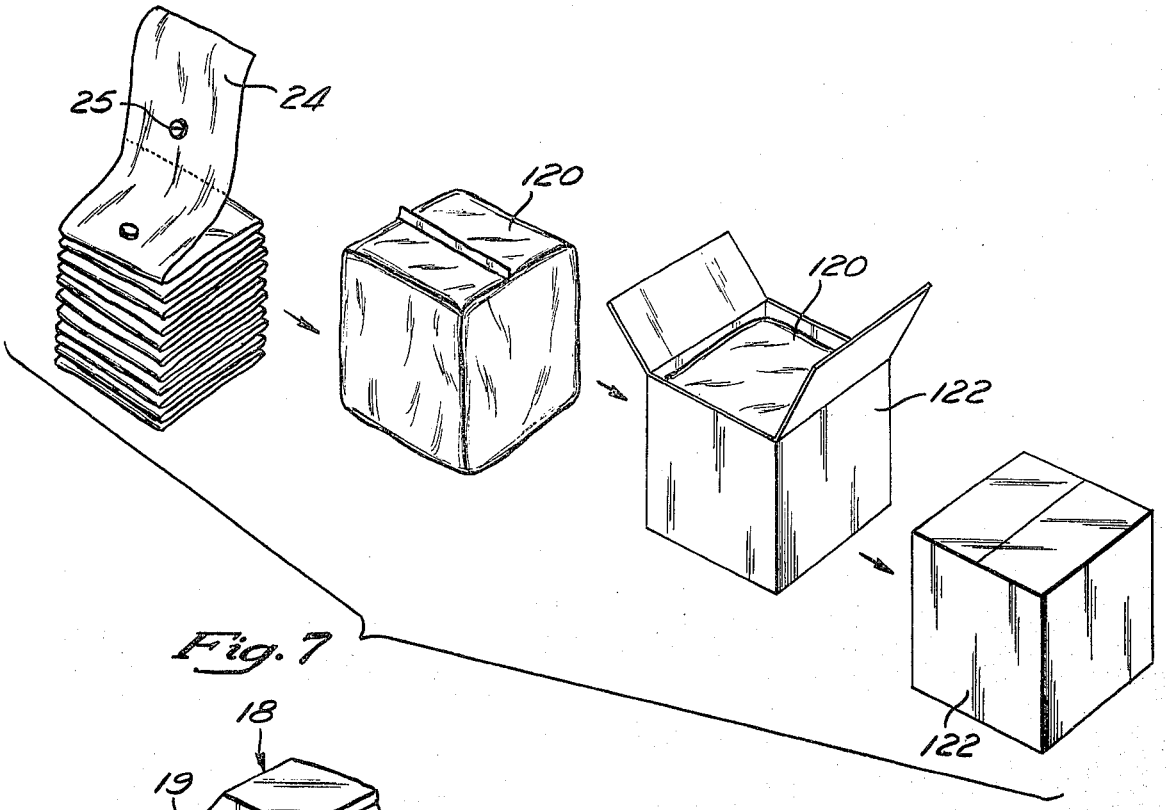
FIG. 7 is a series of perspective views illustrating a method of packaging the continuous web of containers for sterilization.

The aseptic filling apparatus 10 of the present invention utilizes containers 24 which are prepackaged in a sterile container. Although such prepackaging of the containers 24 is known in the art, a description of the packaging process may be useful in fully understanding the operation of the present invention. Referring to FIG. 7, the flexible containers 24 are premanufactured in continuous web form, precapped, and folded at perforations between adjacent containers, in an accordian fashion. The folded containers 24 are then placed in a sealed overwrap container 120, comprising, for example, a plastic bag. Preferably, this overwrap bag 120 is substantially greater in height than the height of the folded containers 24. Air is evacuated from the overwrap bag 120, and the overwrap bag 120, with the containers 24 therein, is placed in a shipping carton 122. The shipping carton 122 is then sealed and placed in a sterilizer (not shown) to sterilize the containers 24. Such sterilization may be accomplished in a conventional manner, such as by radiation.

Operation of the Aseptic Filling Apparatus 10

Figure 8:
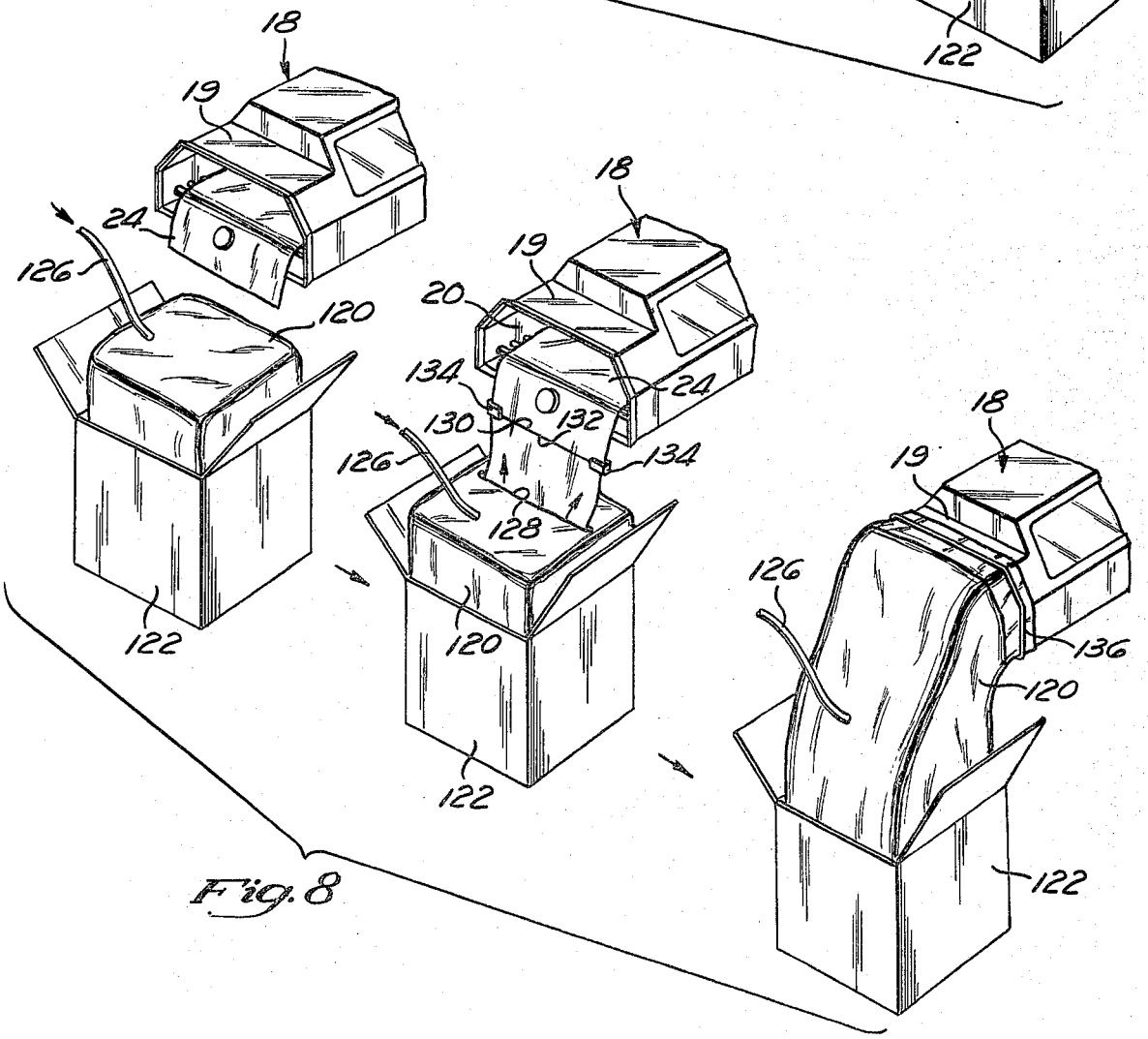
FIG. 8 is a series of perspective view illustrating a method of opening the container overwrap bag to reduce contaminant entry through the opening, and showing a method of sealing this bag opening to the inlet mouth of the chamber to form a relatively sterile tunnel for the containers.

During operation of the aseptic filling apparatus 10, the precapped, premanufactured, prepackaged, and presterilized containers 24 are fed into the elongated chamber 18 in the manner described below. The carton 122 is opened, and a probe 126, connected by tubing (not shown) to the sterile air source 76 (FIG. 1), is inserted through the wall of the sealed overwrap bag 120, as shown in FIG. 8, thereby causing the flow of sterile air through the probe 126 to inflate the sealed overwrap bag 120. An opening 128 is then formed in the overwrap bag 120, as by slitting with a knife (not shown). Preferably, the length of this opening 128 is slightly larger than the width of the web of containers 24 to permit an operator to manually grasp the end of the web of containers 24 and pull it through the opening 128. The operator then connects the leading edge of the web of containers from the overwrap bag 120 to the trailing edge 132 of the web of containers 24 which have been previously fed through the chamber 18. Such connection may be made by a pair of clips 134. It will be recognized that, although the opening 128 exposes the contents of the overwrap container 120 to the atmosphere, and thus, to contaminants, the supply of sterile air through the probe 126 will provide an air flow through the opening 128 to reduce such contamination.

The peripheral edges formed by the opening 128 are then fitted around the inlet mouth 19 and attached thereto, as by a resilient, elastomeric band 136, to seal the opening 128 to the entry port 20. Thus, the overwrap bag 120 provides a relatively sterile tunnel for passage of containers 24 from the carton 122 to the inlet mouth 19. The supply of sterile air through the probe 126 may then be discontinued. The probe 126 may be left in the overwrap bag 120, or alternatively, it may be removed. However, if the probe 126 is removed, it is preferable that the positive pressure in the chamber 18 be sufficiently great to create a positive pressure in the overwrap bag 120 to prevent contaminants from entering through the hole formed by the probe 126.

It will be understood that the foregoing process of connecting the overwrap bag 120 to the inlet mouth 19 may not be necessary in certain environments or for certain food products. In such case, the containers 24 may be fed into the chamber 18 without providing the relatively sterile tunnel formed by the bag 120.

The containers 24 are then serially advanced through the chamber 18 by the feed means, previously discussed in reference to U.S. Pat. No. 4,120,134. Referring again to FIG. 3, as the containers 24 pass through the entry port seal 64, they enter the sterilizing chamber 70 where the continuous hydrogen peroxide mist, dispensed through the spray head 80 (FIG. 2), coats the exterior of the containers 24 to kill any microorganisms that may have contaminated the containers 24 as a result of opening the overwrap bag 120 and exposing of the containers 24 to the atmosphere. In this regard, the rate of advancement of the containers 24 through the chamber 18 is dependent upon the degree of contamination or "bio-load" on the exterior surfaces of the containers 24, and thus, this rate is regulated accordingly. However, it will be recognized that the above-described process of using the overwrap bag to form a tunnel-like enclosure reduces the amount of time that the containers 24 are exposed to the atmosphere, and therefore, advantageously reduces the bio-load on such containers 24. Consequently, because of this reduced bio-load, the required exposure time of the containers 24 to the hydrogen peroxide mist in the compartment 70 is reduced, thereby permitting more rapid advancement of the containers 24. It will also be understood that the interior surfaces of the containers 24 need not be resterilized, since their spouts 25 are capped to prevent contaminants from entering the containers 24.

The containers 24 are then advanced from the sterilizing compartment 70 through the partition 62 and into the drying compartment 72 where the hydrogen peroxide coating thereon is dryed by a flow of heated sterile air. As previously mentioned, this flow of sterile air travels from the opening 106 in the partition 60 through the entire length of the drying compartment 72 and out of the vent pipe 108. The temperature of this air should be sufficient to heat the hydrogen peroxide coating without damaging the containers 24. Such temperature may, for example, be in the range of 150° F. to 190° F. If necessary, contact heaters (not shown) may be attached to the bottom of the drying chamber to boost temperatures and reduce temperature differentials in the drying chamber 72.

Heating of the hydrogen peroxide coating, as is well known, enhances its antiseptic properties, and thus, ensures that the exterior surfaces of the containers 24 are completely sterile when they enter the filling compartment 68. Since the supply of sterile air through the inlet tube 78 (FIG. 2) maintains the filling compartment 68 in an aseptic condition, the sterilized containers 24 will remain sterile during filling. After the containers 24 have been filled, they are carried by the support rollers 23, through the dispensing port seal 66, and onto the inclined conveyor 26 where the container separator 52 (FIG. 1) separates the containers 24 for packaging.

The present invention, therefore, provides an aseptic environment for filling premanufactured, prepackaged, and presterilized flexible containers, connected in continuous web form.

What is claimed is:

1. In a container filling apparatus comprising (a) feed means for serially advancing containers connected in a continuous web, from an entry port to a dispensing port, and (b) an aseptic filling compartment between said ports having a filling means for filling said containers, a method for introducing said containers into said apparatus and dispensing them from said apparatus without introducing contaminants into said aseptic filling compartment, said method comprising:

applying a positive pressure to said aseptic filling compartment, to maintain an aseptic environment in said compartment, by introducing a sterile gas therein;

providing said web of containers prepackaged in a sealed overwrap container and presterilized in said overwrap container;

applying a positive pressure within said overwrap container by introducing sterile gas therein;

forming an opening in said overwrap container to permit connection of said overwrap container to said entry port;

operably connecting one end of said continuous web of containers to said feed means to permit said feed means to advance said continuous web of containers through said apparatus from said entry port to said dispensing port;

sealing said opening in said overwrap container to said entry port;

spraying said containers with an antiseptic liquid, as they are advanced from said entry port to said filling means by said feed means;

heating said containers, prior to reaching said filling means;

advancing said containers to said aseptic filling means, by said feed means, after said containers are heated, to permit said containers to be filled by said filling means; and dispensing said containers, after they are filled, through said dispensing port.

2. A method for introducing and dispensing a continuous web of containers into a filling apparatus, as defined in claim 1, wherein said containers are heated by said sterile gas introduced into said filling compartment.

3. A method for introducing and dispensing a continuous web of containers into a filling apparatus, as defined in claim 2, wherein said sterile gas heats said containers to a temperature between 150° F. and 190° F. to enhance the antiseptic properties of said antiseptic liquid and dry said containers, while preventing damage to said containers.

4. A method for introducing and dispensing a continuous web of containers into a filling apparatus, as defined in claim 1, wherein said sterile gas is introduced into said overwrap container by inserting a probe through said overwrap container to form an opening in said overwrap that is sealed to said probe.

5. A method for introducing and dispensing a continuous web of containers into a filling apparatus, as defined in claim 4, additionally comprising:

removing said probe after sealing said overwrap container to said entry port to permit at least a portion of said sterile gas in said filling chamber to flow through said overwrap container and out of said opening to maintain a positive pressure in said overwrap container.

6. A method for introducing and dispensing a continuous web of containers into a filling apparatus, as defined in claim 1, wherein said antiseptic liquid is hydrogen peroxide.

7. A method for introducing and dispensing a continuous web of containers into a filling apparatus, as defined in claim 1, wherein said entry and dispensing ports have respective elastomeric seals which permit passage of said containers therethrough.

8. In a container filling apparatus, for filling flexible, premanufactured containers, connected in a continuous web, a method of reducing the bio-load on said containers during inputting said containers into said container filling apparatus, comprising:

providing said flexible, premanufactured web of containers in a sealed overwrap container;

introducing a flow of sterile air into said overwrap container to create a positive pressure therein;

forming an opening in said overwrap container to permit said web of containers to be operatively connected to feed through an opening in said apparatus, said flow of sterile air reducing entry of contaminants into said opening in said overwrap container; and sealing said opening in said overwrap container to said opening in said apparatus to form a relatively sterile tunnel for protecting said containers against contamination.

9. A method, as defined in claim 8, wherein said containers are provided in a presterilized, precapped condition.

10. A method, as defined in claim 9, wherein said air is introduced into said overwrap container by inserting a probe, connected to a source of sterile air, through the wall of said container.

11. A method, as defined in claim 10, additionally comprising introducing a flow of sterile air into said apparatus to create a positive pressure therein, said positive pressure in said apparatus creating a positive pressure in said overwrap container if said probe is removed.

12. A method, as defined in claim 8, wherein said overwrap container is a plastic bag.

13. A container filling apparatus, for aseptically filling premanufactured, presterilized, preclosed flexible containers, connected in a continuous web, said apparatus comprising:

a chamber, said chamber including:

an inlet mouth for receiving said premanufactured, presterilized, preclosed containers;

filling means for (a) opening said premanufactured, presterilized, preclosed flexible containers, (b) filling said flexible containers, and (c) reclosing said flexible containers;

an outlet mouth for dispensing said premanufactured,presterilized, preclosed containers after filling by said filling means; and means for providing an aseptic environment at said filling means;

means for serially advancing said flexible containers through said chamber, from said inlet mouth to said filling means and to said outlet mouth; and means for sterilizing exclusively the exterior of said containers as said containers are advanced through said chamber, said sterilizing occurring at a temperature which avoids damage to said containers, and at a location between said inlet mouth and said filling means, said sterilizing means comprising means for applying a chemical fluid sterilizing agent exclusively to the exterior surfaces of said preclosed containers, so that contact of the interior surfaces of said containers by said agent is avoided.

14. A container filling apparatus, as defined in claim 13, wherein said sterilizing means additionally comprises means for drying said containers to remove said sterilizing agent therefrom before filling said containers.

15. A container filling apparatus, as defined in claim 14, wherein said drying means comprises means for providing a flow of heated, sterile air across said containers.

16. A container filling apparatus, as defined in claim 13, wherein said means for providing an aseptic environment in said filling compartment comprises means for maintaining said filling compartment at a positive pressure.

17. A container filling apparatus, as defined in claim 16 wherein said chamber additionally comprises:

a first compartment, in which said sterilizing agent is applied to said containers; and a second compartment for drying said containers to remove said sterilizing agent therefrom.

18. A container filling apparatus, as defined in claim 17 wherein said maintaining means additionally includes means for maintaining said second compartment at a positive pressure.

19. A container filling apparatus, as defined in claim 13, wherein said applying means comprises a spray head which sprays a mist of said sterilizing agent into said first compartment.

20. A container filling apparatus, as defined in claim 17, wherein said maintaining means provides a flow of heated sterile air from said filling compartment to said second compartment to dry said containers to remove said sterilizing agent therefrom.

21. A container filling apparatus, as defined in claim 20, wherein said sterilizing agent is hydrogen peroxide.

22. A container filling apparatus, as defined in claim 20, wherein said chamber additionally comprises a vent for (i) draining condensate, formed by said mist of sterilizing agent, from said chamber, and (ii) venting said sterile air from said chamber.

23. A container filling apparatus, as defined in claim 22, wherein said vent is located in said drying compartment.

24. A container filling apparatus, as defined in claim 13, additionally comprising means for sealing said inlet mouth to said containers, comprising: an elastomeric membrane having a slit therein to permit passage of said containers therethrough, while sealing to the exterior surface of said containers.

25. A container filling apparatus, as defined in claim 24, wherein said elastomeric seal is formed from dental dam.

26. A container filling apparatus, as defined in claim 13, additionally comprising: means for sealing said outlet mouth to said containers, comprising: a first elastomeric membrane having a slit therein to permit passage of said containers therethrough, while sealing to the exterior surface of said containers.

27. A container filling apparatus, as defined in claim 26, wherein said means for sealing said outlet mouth additionally comprises a second elastomeric seal, in spaced parallel relationship to said first elastomeric seal, said second elastomeric seal having a slit therein to permit passage of said containers therethrough, while sealing to the exterior surface of said containers.

28. A container filling apparatus, as defined in claim 27, wherein said elastomeric seals are formed from dental dam.

29. A container filling apparatus, for aseptically filling premanufactured, presterilized, preclosed, flexible containers, connected in a continuous web, said apparatus comprising:

a chamber, having an inlet for receiving said web of premanufactured, preclosed, presterilized, containers, and an outlet for dispensing said web of containers;

means for maintaining said chamber in an aseptic condition as said web moves through said chamber;

means for spraying exclusively the exterior of said containers with a chemical fluid sterilizing agent after they are received through said inlet; and means for (a) opening said preclosed, flexible containers, (b) filling said flexible containers, and (c) reclosing said flexible containers prior to said containers being dispensed through said outlet.

30. A container filling apparatus, as defined in claim 29, additionally comprising means, operably connected to said chamber, for drying said containers after said containers are sprayed by said spraying means.

31. A container filling apparatus, as defined in claim 30, wherein said chamber includes a partition, for dividing said chamber into a filling compartment and a drying compartment, and wherein both said maintaining means and said drying means comprise a source of heated, sterile air connected to said filling compartment, said partition having an opening to permit said air to flow from said filling compartment to said drying compartment.

32. A container filling apparatus, as defined in claim 31, wherein said chamber includes a second partition for further dividing said chamber to form a spraying compartment adjacent to said drying compartment, said spraying means connected to spray said sterilizing agent into said spraying compartment.

33. A carton filling apparatus, as defined in claim 32, wherein said second partition has an opening sized to permit passage of said web of containers therethrough, while preventing the edges of said opening from wiping the edges of said containers.

34. A filling apparatus having a chamber which includes an inlet, an outlet, and a filling means therebetween, a method of aspetically filling flexible containers connected in a continuous web with food substances, said method comprising:

sterilizing said chamber at said filling means;

serially advancing a continuous web of premanufactured, presterilized, preclosed, flexible containers through said chamber from said inlet to said filling means and to said outlet, said flexible containers having an openable closure which, when opened, permits access to the interior of said containers, and when closed, seals the interior of said containers against entry of contaminants therein, the exterior of said containers in a nonaseptic condition at said inlet, and said closure in a closed condition at said inlet, so that the interior of said containers are maintained in a presterilized condition at said inlet;

applying a chemical fluid sterilizing agent exclusively to the exterior surfaces of said premanufactured, presterilized, preclosed, flexible containers to place said flexible containers in an aseptic condition to prevent contamination of said chamber at said filling means, said closure on said containers preventing entry of said fluid sterilizing agent into the interior of said containers during application of said fluid sterilizing agent, said sterilizing of said containers occurring at a location between said inlet and said filling means;

opening said closure on said premanufactured, presterilized, preclosed, flexible containers to provide access to the interior of said containers for filling;

filling said flexible containers with a food substance; and closing said closure on said flexible containers after filling.

35. In a filling apparatus, a method of aseptically filling flexible containers, as defined by claim 34, additionally comprising:

forming an enclosure around said continuous web of premanufactured, presterilized, preclosed, flexible containers at said inlet to protect said flexible containers from atmospheric contaminates.

36. In a container filling apparatus, having filling means for filling premanufactured, presterilized, preclosed, flexible containers connected to a continuous web, a method of reducing contamination of said containers to insure that said containers are in an aseptic condition upon filling at said filling means, said method comprising:

providing an enclosure for said web of premanufactured, presterilized, preclosed, flexible containers;

sealing an opening in said enclosure to an opening in said apparatus to provide an enclosed passage for feeding said web of flexible containers through said apparatus to said filling means, said sealing allowing some entry of microorganism contaminates into said enclosed passage and onto the exterior of said web of containers; and sterilizing exclusively the exterior of said web of flexible containers in said apparatus to kill said microorganism contaminates on said exterior of said containers prior to filling of said containers by said filling means.

37. In a container filling apparatus, a method of reducing contamination, as defined by claim 36, additionally comprising:

introducing a flow of sterile air into said enclosed passage to create a positive pressure therein.

38. In a container filling apparatus, a method of reducing contamination, as defined by claim 37, additionally comprising wherein said introducing of said flow of sterile air occurs during said sealing step.

39. In a container filling apparatus, a method of reducing contamination, as defined by claim 36, additionally comprising:

providing a second opening in said enclosure; and introducing a flow of sterile air into said apparatus to create a positive pressure in said enclosure sufficient to provide air flow through said second opening.

* * * * *